US005852881A

United States Patent [19]

Kuroda et al.

[11] Patent Number: 5,852,881

[45] Date of Patent: Dec. 29, 1998

[54] CLOTHES DRYER

[75] Inventors: Kouichi Kuroda, Gamo-gun; Tatsuya Hirota, Kyoto; Kiyokazu Fujikawa, Inukami-gun; Youzou Kawamura, Koka-gun; Tamotu Kawamura, Yokaichi; Takashi Fukuda, Otsu; Hisanori Hirose, Koka-gun, all of Japan

[73] Assignee: Sanyo Electric Co., Ltd., Moriguchi, Japan

[21] Appl. No.: 898,111

[22] Filed: Jul. 22, 1997

[30] Foreign Application Priority Data

Jul. 31, 1996 [JP] Japan ..... 8-219418

[51] Int. Cl.[6] ..... F26B 13/10

[52] U.S. Cl. ..... 34/527; 34/547; 34/562; 34/572

[58] Field of Search ..... 34/527, 547, 560, 34/562, 572; 318/799, 431, 483; 307/650, 651

[56] References Cited

U.S. PATENT DOCUMENTS 4,857,813 8/1989 Matsumoto et al. ..... 318/54

5,006,778 4/1991 Bashark ..... 318/799

5,454,171 10/1995 Ikeda et al. ..... 34/549 X

FOREIGN PATENT DOCUMENTS

A-60-45879 3/1985 Japan .

*Primary Examiner*—Henry A. Bennett
*Assistant Examiner*—Steve Gravini
*Attorney, Agent, or Firm*—Oliff & Berridge, PLC

[57] ABSTRACT

The inventive clothes dryer is provided with a system for preventing the overheating of the clothes in the drum caused by the abnormality in the V-belt, such as the break or derailment thereof. By the system, the power supply to the motor is halted temporarily while the motor is rotated at a predetermined speed, whereafter the motor keeps rotating due to its inertia. During the inertial rotation of a predetermined period of time, the number of rotations of the motor is counted. When the V-belt is in the normal state, the motor is loaded appropriately, so that the speed of the motor falls rapidly during the inertial rotation, and the number of rotations is accordingly small. When, on the other hand, the V-belt is in an abnormal state, the number of rotations is large. Therefore, the state of the V-belt is checked by comparing the number of rotations to a predetermined value, and when the number is smaller than the predetermined value, the drying operation is stopped.

5 Claims, 8 Drawing Sheets

CLOTHES DRYER

The present invention relates to a clothes dryer.

BACKGROUND OF THE INVENTION

A clothes dryer designed for domestic use includes an air circulation system wherein a flow of dry, hot air is supplied into a drum containing wet clothes, whereby the water held in the clothes is evaporated. The air containing the water evaporated thereby is then cooled to condense the water so that the air is dehumidified. The dehumidified, dry air is then heated by a heater and supplied into the drum again. The drum is rotated slowly about a horizontal axis, whereby the clothes are tumbled in the drum and dried evenly.

In the clothes dryer as described above, the circulating air is generated by a fan rotated, in most cases, by the same motor as used for rotating the drum. That is, the rotation of the motor is transmitted via a driving mechanism including pulleys, V-belts, etc., to both of the fan and the drum, whereby the fan and the drum are rotated at predetermined speeds, respectively. In detail, the drum-driving mechanism includes a pulley fixed to a rotation axis of the drum, a V-belt stretched over the pulley and the outer wall of the cylindrical drum, and a tension mechanism for tensing the V-belt adequately.

In the above clothes dryer, when the V-belt breaks or derails from the pulley or drum, or when the tension of the V-belt is lost due to the breakdown of the tension mechanism, it results that the drum either rotates abnormally or finally stops. When this happens, the hot air is constantly supplied to the clothes lying at or near a supply port for supplying the hot air into the drum, so that the clothes are heated excessively, where some clothes may be discolored or burned, depending on types of the constituent fibers.

In the clothes dryer disclosed in the Publication No. S60-48795 of the Japanese Unexamined Patent Application, the abnormality as described above is detected by detecting an abnormal displacement of a spring used in the tension mechanism. Such a mechanism for detecting the abnormality, however, requires expensive mechanical parts of special designs, which not only increases the production cost but also consumes much time and labor in the assembling.

In view of the above problem, the present invention proposes a clothes dryer provided with a system for preventing the overheat of the clothes in the drum caused by the abnormality in the belt, such as the break or derailment thereof without using a complicated, costly detection mechanism.

SUMMARY OF THE INVENTION

In a clothes dryer for performing a drying operation including steps of supplying air heated by a heater into a drum containing clothes to be dried, dehumidifying the air that has passed through the drum by cooling the air, and supplying the dehumidified air into the drum, thus generating a circulation of the air, said drum being driven via a belt by a motor, the first clothes dryer according to the present invention is characterized in that it includes:

a) a rotation detector for generating a rotation signal for each preset rotation of the motor;

b) a motor controller for driving the motor for a first predetermined period of time and then stopping a power supply to the motor for a second predetermined period of time in an initial phase of the drying operation;

c) a rotation counter for counting the number of rotation signals generated by the rotation detector during the second predetermined period of time;

d) an abnormality detector for detecting an abnormality by comparing the number of the rotation signals counted by the rotation counter to a predetermined value; and e) an operation arrestor for stopping the drying operation when an abnormality is detected by the abnormality detector.

In the first clothes dryer, the motor controller supplies driving current to the motor so that the speed of the motor rises to a predetermined normal speed, and then stops driving the motor when the first predetermined period of time has elapsed, where the first predetermined period of time is set beforehand adequately for the motor to attain the predetermined normal speed. Even after the motor controller stops driving the motor, the motor keeps rotating due to its inertia. During the inertial rotation, the speed of the motor falls more rapidly as the load on the motor is larger, and vice versa. While the power supply to the motor is halted for the second predetermined period of time, the rotation detector detects a preset (whole or a fraction) rotation of the motor and generates a rotation signal synchronized with each preset rotation of the motor, and the rotation counter counts the number of rotation signals. If the connection by the belt between the motor and the drum is normal, the motor is loaded appropriately, so that the speed of the motor falls considerably during the inertial rotation. If, on the other hand, the connection is lost due to the break or derailment of the belt, the speed of the motor does not fall so rapidly as in the normal state during the inertial rotation. Thus, by comparing the number of rotation signals counted by the rotation counter to the predetermined value, the abnormality detector checks the state of the belt, and the operation arrestor stops the drying operation when the abnormality is detected by the abnormality detector.

By the first clothes dryer as described above, even when an abnormality such as the break or derailment of the belt happens before a drying operation is started, the abnormality is detected assuredly in the initial phase of the operation and then the drying operation is stopped immediately, thus preventing the overheating of the clothes in the drum.

In addition to carrying out the abnormality detecting operation in the initial phase of a drying operation as described above, it is further preferable to carry out another abnormality detecting operation also in the course of the drying operation to detect the break or the like of the belt that may happen during the drying operation.

In view of this, the present invention proposes a second clothes dryer as a modification to the first clothes dryer, which is characterized in that the motor controller also stops the power supply to the motor for a third predetermined period of time after the drying operation is carried out for a predetermined period of time, the rotation counter counts the number of rotation signals generated by the rotation detector during the third predetermined period of time, and the operation arrestor stops the drying operation when an abnormality is detected by the abnormality detector. Here, the third predetermined period of time may be the same as the second predetermined period of time to simplify the constitution.

By the second clothes dryer, even when an abnormality such as the break or derailment of the belt happens during the drying operation, the abnormality is detected assuredly after the drying operation is carried out for the predetermined period of time and then the drying operation is stopped immediately, thus preventing the overheating of the clothes in the drum.

In the second clothes dryer, however, the drying performance is inevitably deteriorated since the speed of the motor is lowered when the power supply to the motor is halted temporarily. Therefore, it is desired not to carry out the abnormality detecting operation when it is assured that the belt is in the normal state.

In view of this, the present invention proposes a third clothes dryer as a modification to the second clothes dryer, which is characterized in that it includes a load estimating unit for estimating a load on the motor before the power supply to the motor is stopped in the abnormality detecting operation after the drying operation is carried out for the predetermined period of time, and when the load is found to be smaller than a predetermined value, the power supply to the motor is stopped to detect the abnormality.

In the third clothes dryer, the load estimating unit estimates the load on the motor without lowering the speed of the motor. When the load estimated thereby is smaller than the predetermined value, it is highly probable that an abnormality such as the break or derailment of the belt has happened. Therefore, the motor controller stops the power supply to the motor to carry out the abnormality detecting operation only when the load on the motor estimated by the load estimating unit is smaller than the predetermined value.

The fourth clothes dryer according to the present invention, which is a modification to the third clothes dryer, relates especially to a clothes dryer wherein the rotation of the motor is controlled by a phase control method.

Phase control method is generally used for controlling the rotation of a motor. In the method, a motor-on signal is sent to a triac or a similar device, provided for turning on and off the power supply to the motor, at a phase angle delayed by a predetermined angle from each zero crossing point in the alternating current, whereby the triac turns on and the power supply to the motor is started. The phase angle is usually defined within 0°–180° where each zero crossing point is defined as 0°, and the phase angle at which the motor-on signal is generated is referred to as "phase control angle" hereinafter. When the phase control angle is changed, the power supplied to the motor is changed accordingly. Thus, the rotation of the motor can be controlled by varying the phase control angle. When the load on the motor is larger, more power is required to rotate the motor and, accordingly, the phase control angle becomes smaller, if the motor is to be rotated at a constant speed.

The fourth clothes dryer, which is based on the above knowledge, is characterized in that the load estimating unit determines a phase control angle corresponding to the power supplied to the motor while the motor is controlled to rotate at a predetermined speed. For example, while the motor is rotated at a predetermined speed, the load estimating unit judges whether the phase control angle is larger than a predetermined value. If the phase control angle is larger than predetermined, it is assumed that the load on the motor is so small that it is highly probable for the belt to be in an abnormal state. Another method of estimating the load on the motor based on the phase control angle will be detailed later in describing a preferred embodiment of the present invention, wherein a range of phase angle where the motor-on signal is maintained at a high level is calculated based on the phase control angle, and the range of phase angle is compared to a predetermined reference value for judging whether the load on the motor is normal.

By the third or fourth clothes dryer, the speed of the drum is lowered to carry out the abnormality detecting operation only when the load estimating unit concludes that the load on the motor is abnormally small. In other words, when the load on the motor is found to be normal, it is assumed that the belt is in the normal state, and the abnormality detecting operation is not carried out. Therefore, such a situation is avoided where the speed of the motor is lowered to carry out the abnormality detecting operation even though there is little or no probability of the abnormality, and the drying performance is maintained accordingly.

The fifth clothes dryer according to the present invention, which is a modification to the third clothes dryer, is characterized in that an additional process of detecting the abnormality is carried out a plurality of cycles even when no abnormality is detected in the abnormality detecting operation carried out after the drying operation is continued for the predetermined period of time, and if no abnormality is detected in the additional process, the drying operation is continued further. The additional process includes steps of driving the motor for a fourth predetermined period of time, then stopping the power supply to the motor for the third predetermined period of time, and comparing the number of rotation signals generated by the rotation detector during the third predetermined period of time to a predetermined value. Here, the fourth predetermined period of time may be the same as the first predetermined period of time to simplify the constitution.

By the fifth clothes dryer, the abnormality that has happened during the drying process can be detected assuredly by the repetition of the additional process. Here, when the number of repetitions of the additional process is increased, the detection of abnormality can be more reliable, whereas the drying performance deteriorates since the speed of the drum is lowered many times. Taking account of this, the number of repetitions should be set at a moderate value, three times, for example.

By the fifth clothes dryer, since the abnormality detecting operation is repeated a plurality of times after the drying operation is continued for a predetermined period of time, the probability of failure in detecting the abnormality is decreased greatly and the reliability of detection is enhanced.

BRIEF DESCRIPTION OF THE DRAWING

A preferred embodiment of the present invention is disclosed in the following part of the specification, referring to the attached drawings wherein.

DETAILED DESCRIPTION OF A PREFERRED EMBODIMENT

Figure 1:
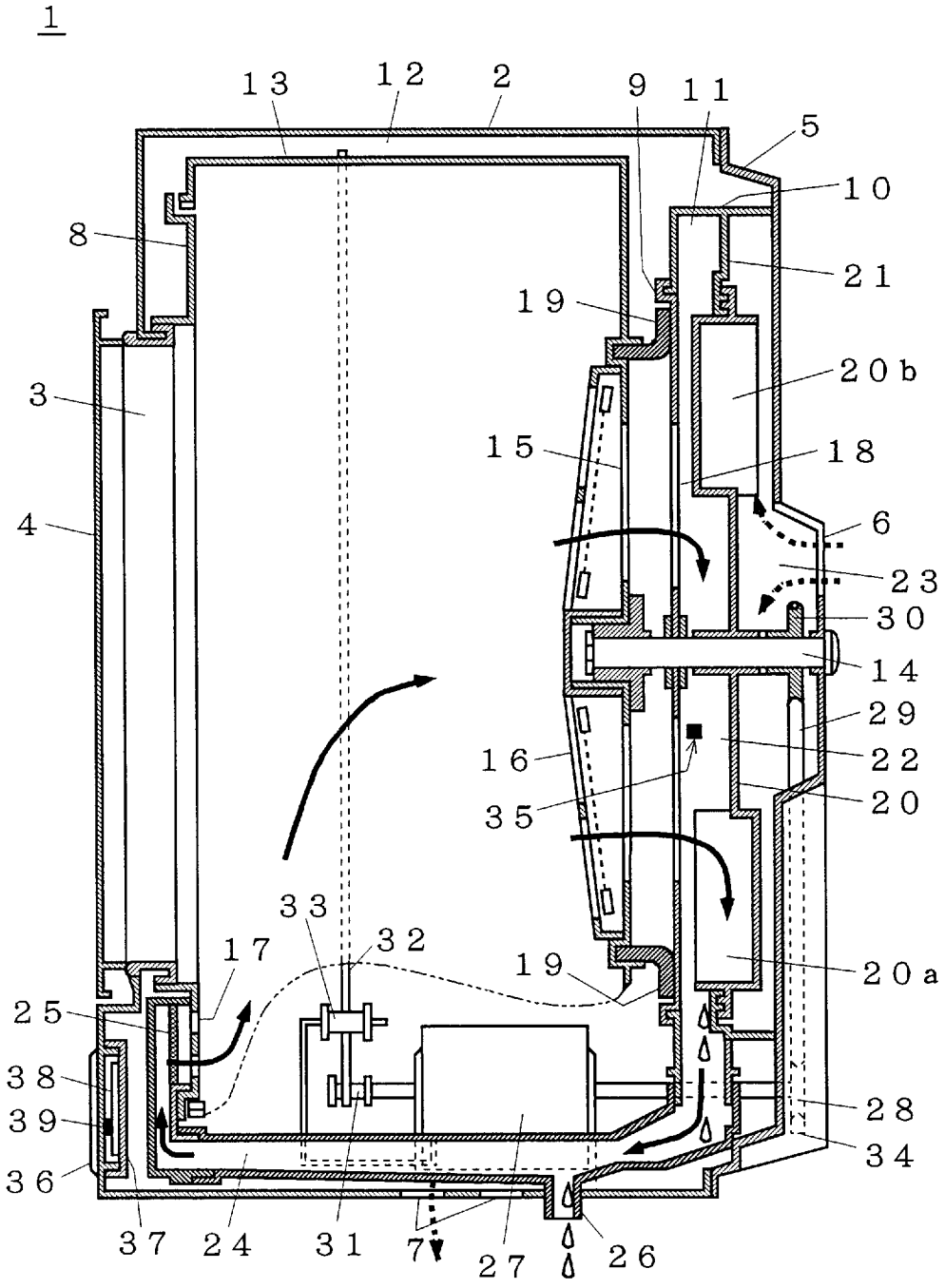
FIG. 1 is a vertical section of an inventive clothes dryer viewed from a side.

Referring to FIG. 1, the whole configuration of an inventive clothes dryer is described as follows. In the clothes dryer 1, a frame 2 is provided with a clothes inlet 3 in the center of its front, and the inlet 3 is closed by a door 4. A rear plate 5 is fixed to the back of the frame 2, and an air inlet 6 for introducing the ambient air is provided at about center of the rear plate 5. An air outlet 7 for discharging the air is provided at the bottom of the frame 2. In the front part of the frame 2, a supporting plate 8 consisting of a sheet metal shaped into a ring is fixed so that it surrounds the clothes inlet 3. In the rear part of the frame 2, a supporting plate 9 is positioned parallel to and at a predetermined distance from the rear plate 5. A fan casing 10, which is partially broken away, is fixed to the supporting plate 9. The fin casing 10 and the supporting plate 9 constitute a wall which divides the space in the frame 2 into a fan chamber 11 and a drying chamber 12.

In the drying chamber 12, a drum 13 having a horizontal rotation axis is mounted with its open end directed to the clothes inlet 3. The front part of the drum 13 is supported by the drum supporting plate 8 via a felt or the like and the rear part is rotatably supported by a main shaft 14. An air introduction port 17 for introducing air into the drum 13 is formed in the lower part of the drum supporting plate 8, whereas an air exit port 15 covered with a lint filter 16 is formed at the back of the drum 13. In the supporting plate 9, vent ports 18 are formed for the conveyance of air between the fan chamber 11 and the drying chamber 12. A seal member 19 is inserted between the drum 13 and the supporting plate 9 whereby the flow of air from the air exit port 15 is conveyed to the vent ports 18 assuredly.

In the fan chamber 11, a disc-shaped duplex fan 20 made of synthetic resin is fixed to the main shaft 14. The structure of the duplex fan 20 is such that a plurality of vanes are formed radially on both sides of a disc, where the vanes facing the drying chamber 12 constitute a circulating fan 20*a* and the vanes facing the rear plate 5 constitute a cooling fan 20*b*. Further, the duplex fan 20 is provided with circular grooves formed concentrically in the circumference of the side which is facing the supporting plate 9. The duplex fan 20 is set in a circular opening formed in about the center of a vertical wall 21 provided in the fan casing 10, so that the duplex fan 20 together with the wall 21 constitutes a shield for dividing the fan chamber 11 into a dehumidifying passage 22 and a cooling passage 23. The wall 21 is provided with circular grooves formed concentrically around the opening at the side which is facing the rear plate 5. When the duplex fan 20 is set in the opening of the wall 21, the circular grooves of the duplex fan 20 are engaged loosely with the circular grooves of the wall 21 without contact between them. That is, the grooves of the duplex fan 20 and the grooves of the wall 21 constitute a labyrinth seal, so that the exchange of air does not occur between the dehumidifying passage 22 and the cooling passage 23.

The lower part of the dehumidifying passage 22 is connected by a duct 24 with the air introduction port 17 formed in the drum supporting plate 8. In the duct 24, a heater 25 is disposed near the air introduction port 17, where the heater 25 is composed using a honeycomb-shaped positive temperature coefficient thermistor, for example. In the lowest part of the duct 24, a water discharge port 26 is provided for discharging the water condensed in the duct 24.

At the bottom of the frame 2 is disposed a motor 27 which is provided with pulleys 28 and 31 at both end of its rotation shaft, respectively. A V-belt 32 is stretched over the drum 13 and the pulley 31 so that the drum 13 is driven by the motor 27. Similarly, a fan belt 29 is stretched over the pulley 28 and another pulley 30, which is integrally formed in the center of the cooling fan 20*b*, to drive the duplex fan 20. An idle pulley 33 is provided for tensing the V-belt 32 during the rotation of the drum 13, whereby the V-belt 32 is prevented from slipping on or derailing from the drum 13. A rotation sensor 34 for detecting the rotation of the motor 27 is fixed to the pulley 28.

During the drying operation, the rotation of the motor 27 is transmitted to both the drum 13 and the duplex fan 20 so that the drum 13 is rotated at a low speed whereas the duplex fan 20 is rotated at a high speed. Meanwhile, a power is supplied to the heater 25, whereby the dry air is heated. Thus, a circulation of air is generated by the circulating fan 20*a* through the dehumidifying passage 22, the duct 24 and the drum 13, wherein the air heated by the heater 25 evaporates the water held in the clothes when it passes the drum 13. On the other hand, due to the rotation of the cooling fan 20*b*, the ambient air is introduced from the air inlet 6 into the cooling passage 23 and exhausted out of the air outlet 7, where the duplex fan 20 is cooled by the air introduced. Therefore, when the hot air coming from the drum 13, which contains the evaporated water, comes in contact with the duplex fan 20, the air is cooled, whereby the water is condensed and the condensed water flows down the wall of the dehumidifying passage 22 and is discharged from the water discharge port 26.

At the air exit port 15 of the drum 13, an exit temperature sensor 35 is disposed for detecting the temperature of the air coming from the drum 13. The exit temperature sensor 35 may be constituted using a heat sensitive device such as thermistor, for example. In the lower part of the front of the frame 2, an operation panel 36, which will be detailed later, is provided. At the back of the operation panel 36, a board casing 37 made of synthetic resin is fixed with machine screws to the inside of the frame 2, and a control board 38 is confined in the board casing 37. The control board 38 is composed of a member having such a large heat capacity that it is hardly affected by a sudden change in the ambient temperature. On the control board 38 are mounted various electronic devices including a microcomputer, which will be detailed later, an ambient temperature sensor 39 for detecting the temperature of the control board 38, etc.

Figure 2:
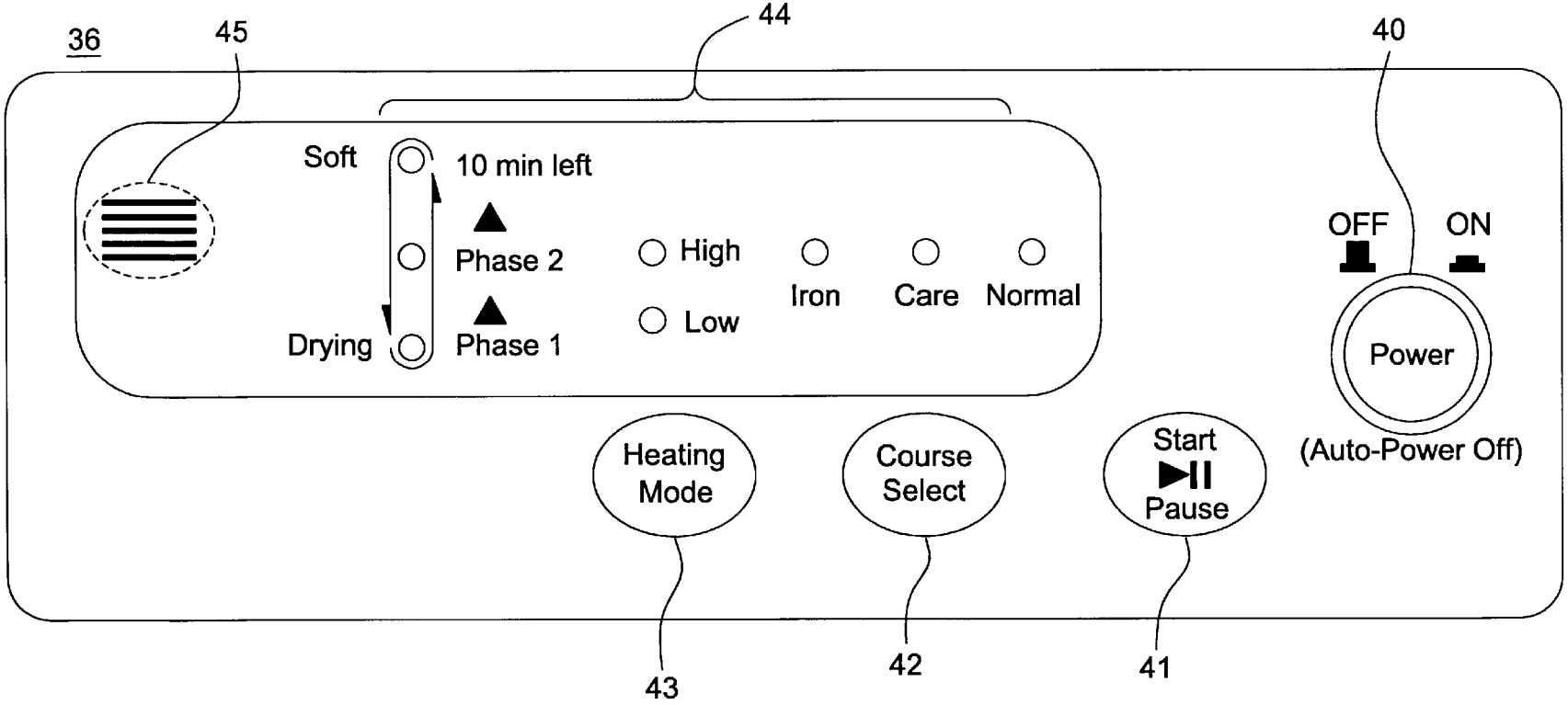
FIG. 2 is a front view of an operation panel of the above clothes dryer.

FIG. 2 is a front view of the operation panel 36. As shown in FIG. 2, the operation panel 36 is provided with various keys including a power key 40 for turning on the power, a start key 41 for starting or pausing a drying operation, a selection key 42 for selecting one of the drying modes such as "NORMAL", "CARE", and a heater control key 43 for changing the degree of heating, a group of light emitting diodes (LEDs) 44 for indicating the state of procedure of the drying operation, and an electronic buzzer 45 for generating predetermined sounds when one of the keys is operated or an abnormality has been detected.

Figure 3:
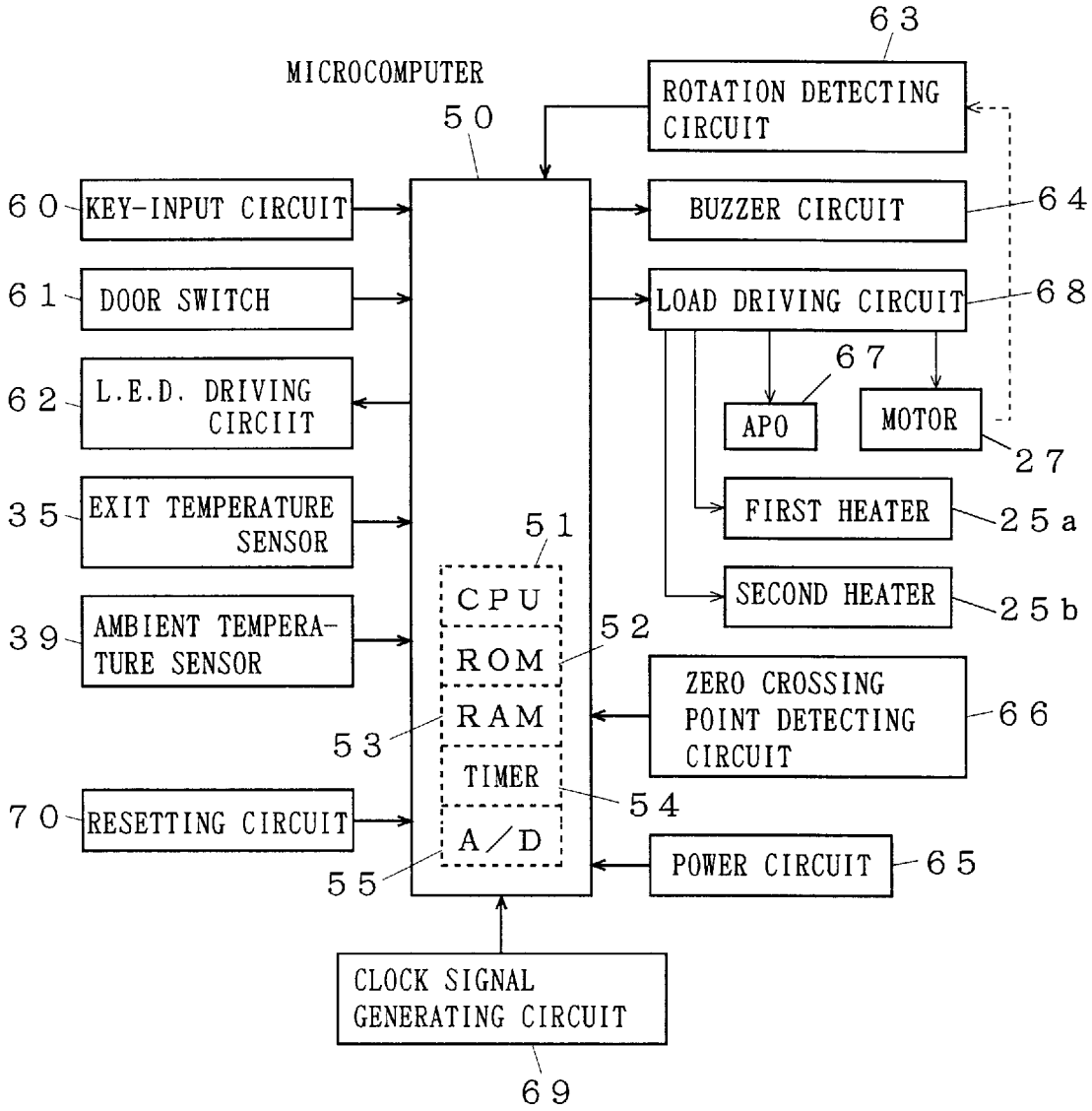
FIG. 3 shows the configuration of the electrical system of the above clothes dryer.

FIG. 3 shows a configuration of the electrical system of the clothes dryer 1. In this system, a microcomputer 50 including a central processing unit (CPU) 51, a read-only memory (ROM 52, a random access memory (RAM) 53, a timer 54 and an analogue-to-digital (AID) convertor 55, is provided for controlling each part of the clothes dryer 1 to conduct a drying operation according to an operation program stored in the ROM 52 beforehand. The microcomputer 50 is connected with circuits and devices, such as: a key-input circuit 60 including the keys of the operation panel 36; a door switch 61 for detecting the opening or closing of the door 4; the LED driving circuit 62 for driving the LEDs of the operation panel 36; the exit temperature sensor 35; the ambient temperature sensor 39; a rotation detecting circuit 63 including the rotation sensor 34; a buzzer circuit 64 for driving the buzzer 45; a power circuit 65 connected to the commercial power supply source; a zero crossing point detecting circuit 66 for detecting a zero crossing point in the current supplied from the commercial power source; a load driving circuit 68 for driving the motor 27, two heaters 25*a* and 25*b* both constituting the heater 25 as described above, and an automatic power-off (APO) circuit 67 for shutting down the power supply automatically after a drying operation is completed; a clock signal generating circuit 69 for generating master clock signals; and a resetting circuit 70.

Figure 4A:
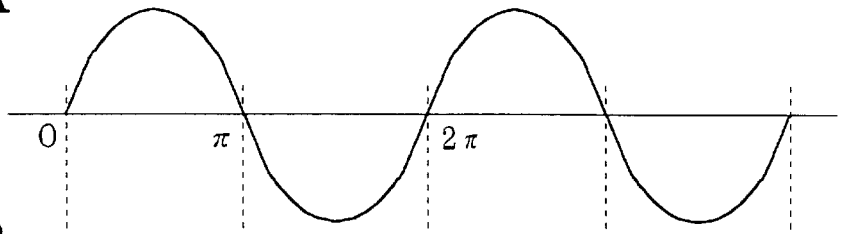
FIGS. 4A–4D are diagrams showing waveforms for explaining the process of controlling the rotation of a motor of the above clothes dryer.
Figure 4B:
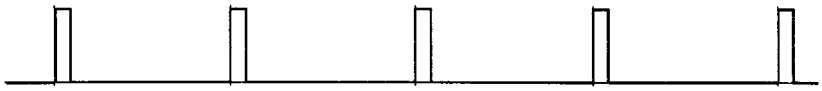

In respect of the clothes dryer as described above, the process of controlling the rotation of the motor 27 is described as follows, centering around the process of detecting the abnormality in the V-belt. First, referring to FIGS. 4A and 4B, when a voltage supplied from the commercial power source has a waveform as shown in FIG. 4A, the zero crossing point detecting circuit 66 generates a pulse signal every time the voltage crosses the zero-level, as shown in FIG. 4B. The interval of time of generating the pulse signal depends on the frequency at which the voltage oscillates. As for Japan, for example, there are two frequencies adopted for the commercial power supply, i.e. 50[Hz] and 60[Hz]. Therefore the interval of time of generating the pulse signal can be calculated as 10[msec] and 8.3[msec] for 50[Hz] and 60[Hz], respectively.

Figure 4C:
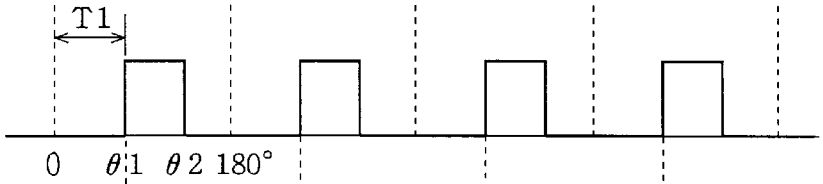
Figure 4D:
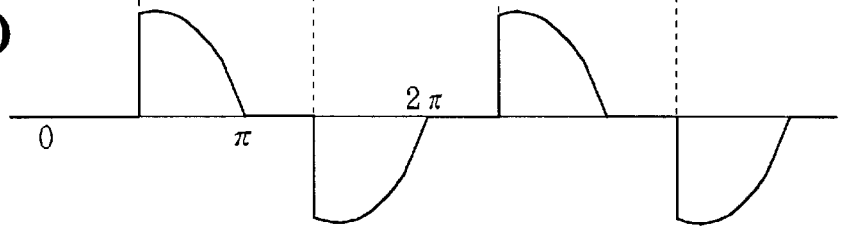

In the load driving circuit 68, a semiconductor switching device such as triac turns on and off the current supplied to the motor 27. When the speed of the motor 27 is to be raised to a normal rotation speed rapidly, a motor-on signal kept at a continuous high level is sent to the triac so that the current with the same waveform as shown in FIG. 4A is supplied to the motor 27. When, on the other hand, the motor is to be rotated at a predetermined speed which is lower than the normal speed, a motor-on signal as shown in FIG. 4C is sent to the triac. In FIG. 4C, the motor-on signal is turned to the high level at a phase angle $\theta 1$ delayed by a delay time T1 from a zero crossing point and then to the low level at a predetermined phase angle $\theta 2$ which is delayed further, where $\theta 2$ is predetermined properly, 130°, for example. As a result, the motor current with the waveform as shown in FIG. 4D is supplied to the motor 27, wherein the current is supplied only within the range of the phase angle of $\theta 1°$–180°. The microcomputer 50 regulates the speed of (or the torque on) the motor 27 by changing the delay time T1, or the phase angle $\theta 1$, so that the power supplied to the motor 27 is changed. In addition, in FIG. 4C, the range of the phase angle where the motor-on signal is at the high level, i.e. the difference between $\theta 1$ and $\theta 2$, is referred to as the conduction angle $\alpha(=\theta 2-\theta 1)$ hereinafter.

Referring to the flow charts of FIGS. 5–8, the operation of the microcomputer 50 is described as follows, centering around the process of detecting the abnormality in the V-belt.

Figure 5:
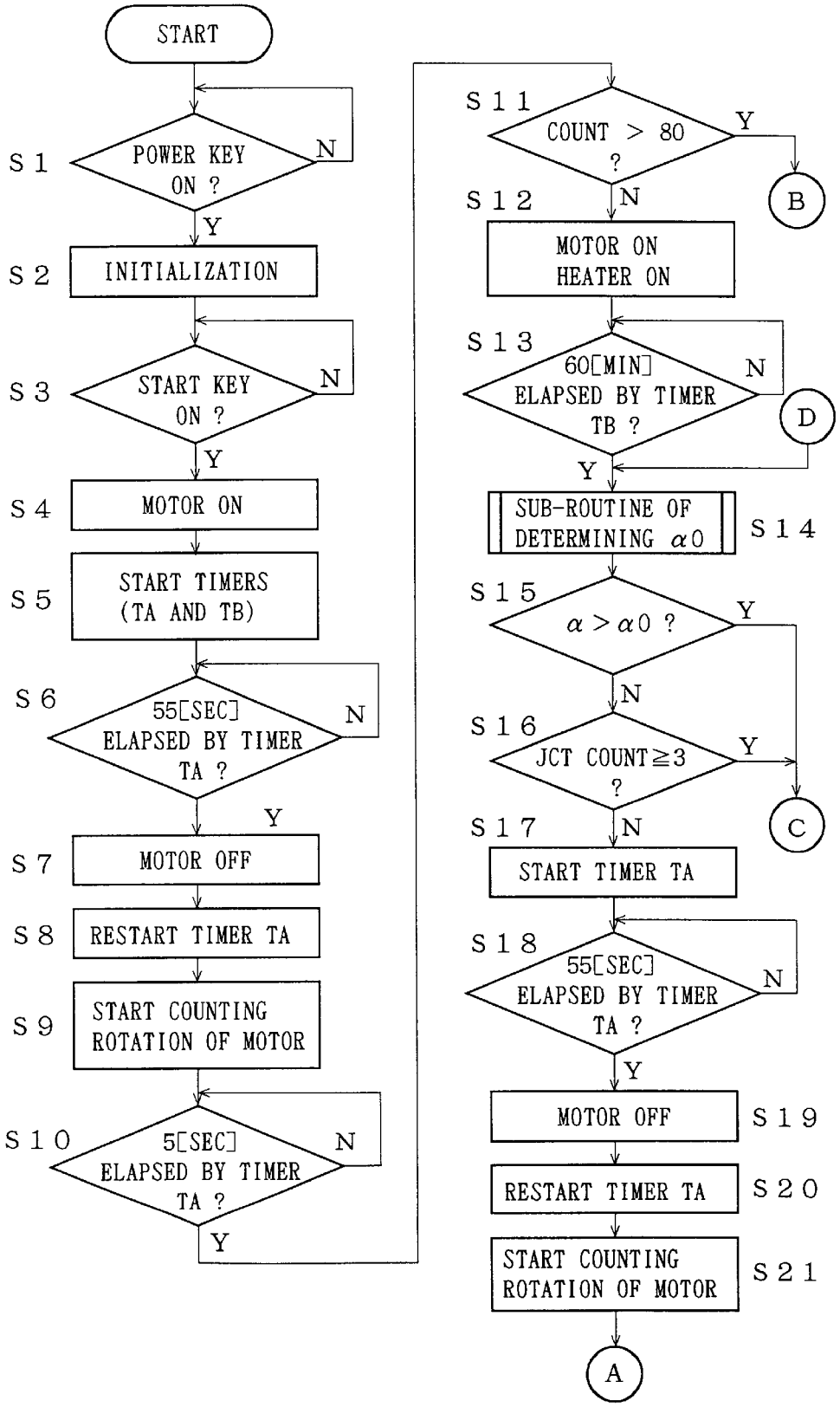
FIGS. 5 and 6 are flow charts of the process of detecting the abnormality in the V-belt.
Figure 6:
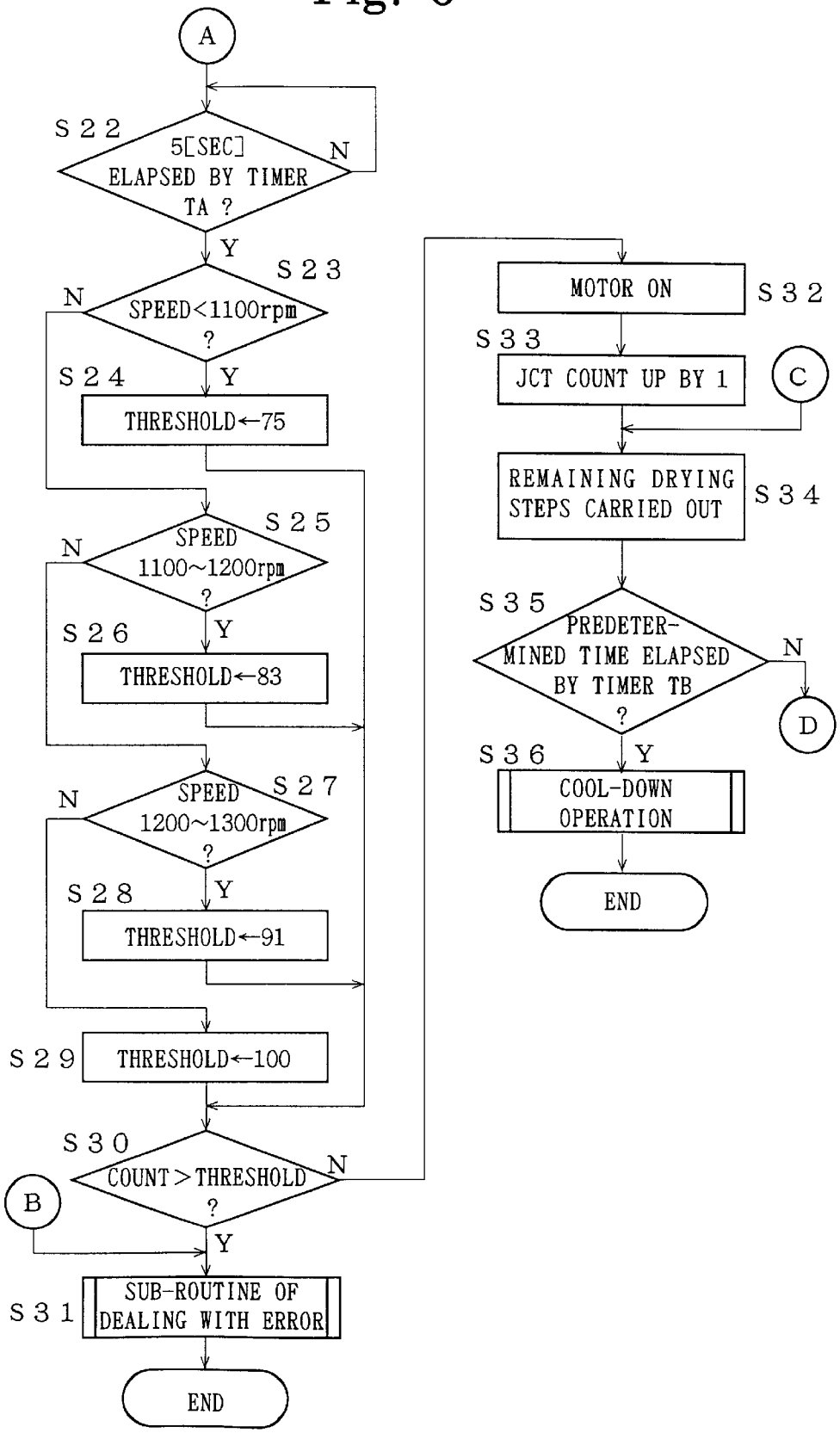

FIGS. 5 and 6 as a whole show a flow chart from the start to the end of the drying operation. First, when the power key 40 is turned on (Step S1), the microcomputer 50 receives a reset signal from the resetting circuit 70 and carries out an initialization process (Step S2), whereby flags and parameters used in the operation are reset.

After putting wet clothes in the drum 13, when a user presses the start key 41 (Step S3), the microcomputer 50 sets the objective speed of the motor 27 at 1150[r.p.m.], for example, and starts the motor 27 (Step S4), whereby the speed of the motor 27 rises to the objective speed rapidly, and the drum 13 and the duplex fan 20 are rotated at speeds determined according to speed reducing ratios, respectively.

On starting the motor 27, a first timer TA for measuring a period of time for carrying out the process of detecting the abnormality in the V-belt, and a second timer TB for measuring the elapsed time after the operation is started, are also started (Step S5).

When 55[sec] have elapsed by the first timer TA (Step S6), the current to the motor 27 is turned off by setting the motor-on signal to be continuously low (Step S7), whereafter the motor 27 keeps the inertial rotation. On turning off the current, the first timer TA is reset and restarted (Step S8), and a rotation counter for counting pulse signals generated by the rotation detecting circuit 63 which generates a pulse signal for each rotation of the motor 27, is reset to start counting the pulses (Step S9). In the above process, the time at which the current is turned off in Step S6 need not be 55[sec] and may be preferably set as short as possible within a range where the motor 27 can attain the objective speed so that the process of detecting the abnormality is carried out as soon as possible after starting the drying operation.

When 5[sec] have elapsed by the first timer TA (Step S10), the number of the count by the rotation counter is compared to an initial threshold value predetermined for judging the number of rotations of the motor (Step S11). Here, if the connection by the V-belt 32 between the drum 13 and the pulley 31 is in the normal state, the pulley 31 is loaded so appropriately that the speed of the motor 27 falls rapidly and the number of rotations detected during the above 5[sec] becomes a small value. If, on the other hand, the V-belt 32 is broken or derailed from the drum 13 and the pulley 31, the load on the pulley 31 is so small that the motor 27 keeps rotating at a considerably high speed due to its inertia, thus the number of rotations detected during the above 5[sec] becomes a large value. Therefore, in Step S11, when the number of the count by the rotation counter is found to be larger than the threshold value, the operation proceeds to Step S30 to carry out a sub-routine of dealing with an error. In the present case, the initial threshold value is set at 80 as shown in Step S11, for example. Of course the threshold value may be set at a different value so long as the number of rotations of the motor 27 can be judged properly based on the value.

In Step S11, if the number of the count by the rotation counter is smaller than 80, it is concluded that the connection by the V-belt 32 between the drum 13 and the motor 27 is normal. Therefore, after setting the objective speed at a predetermined value, the microprocessor 50 restarts driving the motor 27 and supplying power to the heater 25 (Step S12). Thus the drying operation is started.

After the drying operation is started, the difference in temperature is monitored automatically between the temperature of the air coming from the drum 13 measured by the exit temperature sensor 35 and the temperature of the control board 38 measured by the ambient temperature sensor 39, and when the difference becomes larger than a predetermined value, the drying operation is completed.

The time required for the drying operation depends on the amount of clothes contained in the drum 13. That is, when the amount of clothes is small, the water held in the clothes is evaporated in a relatively short period of time and, accordingly, the time required for the drying operation is short. When, on the other hand, the amount of clothes is larger, longer time is required for the drying operation to be completed. Otherwise, even when the amount of clothes is small, the time required for the drying operation becomes long if the constituent fibers of the clothes have such a property that the water held therein cannot be evaporated easily. Further, the time required for the drying operation becomes long when the drum 13 is not driven properly by the motor 27.

In short, when the drying operation is continued for an unusually long period of time, there is a possibility that the connection by the V-belt between the motor 27 and the drum 13 is in the abnormal state.

Figure 7:
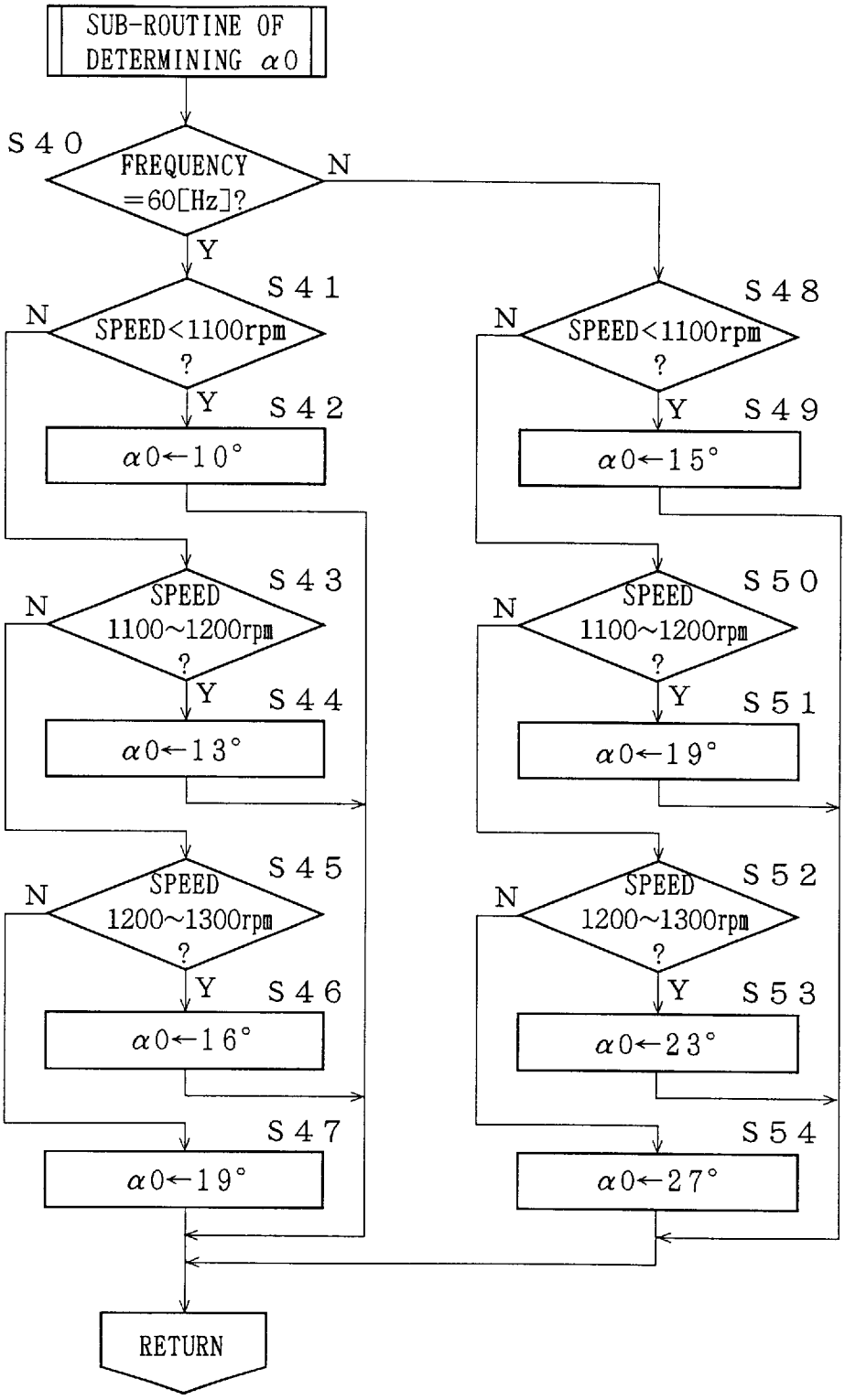
FIG. 7 is a flow chart of a sub-routine of setting the reference conduction angle included in the process of detecting the abnormality in the V-belt.

Therefore, in the present clothes dryer, when 60[min] has elapsed by the second timer TB (Step S13), the process of detecting the abnormality in the V-belt is carried out, where, of course, the time 60[min] is a mere example and may be determined as desired. In the process, first, a sub-routine of setting the reference conduction angle, which will be detailed later referring to FIG. 7, is carried out to determine the reference conduction angle $\alpha$0 (Step S14), to which the actual conduction angle $\alpha$ at the moment is compared (Step S15). Here, when the actual conduction angle $\alpha$ is smaller than the reference conduction angle $\alpha$0, the operation proceeds to Step S16, and when the actual conduction angle $\alpha$ is larger than the reference conduction angle $\alpha$0, the operation proceeds to Step S34.

In Step S16, the number of the count by a judgement counter, which is referred to as JCT hereinafter, is compared to a predetermined value, 3, for example. The JCT is a counter for counting how may times the process of detecting the abnormality in the V-belt, including Steps S17 –S32 which will be described later, is repeated. In Step S16, when the count is smaller than 3, the operation proceeds to Step S17, and when the count is equal to or larger than 3, the operation proceeds to Step S34.

The process of Steps S17–S22 is the same as that of Steps S5–S10 except for the operation of the second timer TB. That is, the first timer TA is reset and restarted (Step S17), and when 55[sec] have elapsed by the first timer TA (Step S18), the current to the motor 27 is turned off by setting the motor-on signal to be low constantly (Step S19), whereafter the motor 27 keeps the inertial rotation. On turning off the current, the first timer TA is reset and restarted (Step S20), and the rotation counter is reset to start counting (Step S21).

When 5[sec] have elapsed by the first timer TA (Step S22), the threshold value for judging the number of rotations of the motor is determined depending on the speed of the motor 27 at that moment. That is, the threshold value is set at 75, 83, 91 or 100 when the speed of the motor 27 is a) smaller than 1100[r.p.m.], b) between 1100–1200[r.p.m.], c) between 1200–1300[r.p.m.], or d) larger than 1300[r.p.m], respectively (Steps S23, S24, S25, S26, S27, S28 and S29). After that, the number of the count by the rotation counter is compared to the above threshold value (Step S30), and when the number of the count by the rotation counter is larger than the threshold value, the operation proceeds to Step S31 to carry out the sub-routine of dealing with an error.

In Step S30, when the number of the count by the rotation counter is equal to or smaller than the threshold value, it is concluded that the drum 13 is driven normally, so that the operation proceeds to Step S32 where the power supply to the motor 27 is restarted, and further to Step S33 where the number of the count by the JCT is increased by 1. Then the remaining steps of the drying operation are carried out (Step S34) and the elapsed time measured by the second timer TB is checked (Step S35). In Step S35, when it is found that a predetermined period of time has elapsed, the operation proceeds to Step S36 to carry out a cool-down operation. When, on the other hand, it is found that the predetermined period of time has not elapsed, the operation returns to Step S14 to carry out the sub-routine of setting the reference conduction angle.

The number of the count by the JCT, which is reset in Step S2, is increased in Step S33 and judged in Step S16, as described above. That is, the number of the count by the JCT is increased every time the process of detecting the abnormality in the V-belt is carried out through Steps S17–S32, and when the conduction angle $\alpha$ is found to be smaller than the reference conduction angle $\alpha$0, the number of the count by the JCT is judged first. Then, the process of detecting the abnormality in the V-belt is carried out if the number is smaller than the threshold value. According to such a flow chart, the sub-routine of setting the reference conduction angle (Step S14) and judgement on the conduction angle $\alpha$ (Step S15) are repeated until the end of the drying operation, and the process of detecting the abnormality in the V-belt may be repeated up to three times while the conduction angle $\alpha$ is smaller than the reference conduction angle $\alpha$0. On the other hand, even when the conduction angle $\alpha$ is found to be smaller than the reference angle $\alpha$0, if a judgement such that the motor 27 is loaded appropriately even during the inertial rotation, is obtained in Step S30 three times continuously, the process of detecting the abnormality in the V-belt is not carried out any more.

In addition, the elapsed time measured by the second timer TB is checked at the appropriate intervals of time even before the operation reaches Step S35. There, as soon as the predetermined time has elapsed, the power supply to the heater 25 is stopped and the operation proceeds to Step S36.

Referring to FIG. 7, the sub-routine of setting the reference conduction angle in Step S14 is described as follows. In the following description, it is assumed that the clothes dryer is designed for use in Japan.

In this sub-routine, the reference conduction angle $\alpha$0, which is used as a threshold for judging the conduction angle $\alpha$ in Step S15, is determined corresponding to the speed of the motor 27 at that moment and the power supply frequency, based on the following reasoning.

Provided that the power supply frequency is constant, if the speed of the motor 27 is higher, the conduction angle $\alpha$ must be larger since the power supplied to the motor 27 must be larger. Therefore, the reference conduction angle $\alpha$0 is determined at a larger value. Next, provided that the power is supplied to the motor 27 at the same rate, if the power supply frequency is smaller, the conduction angle $\alpha$ must be larger to rotate the motor at the same speed since the number of waves of the power generated per unit time (e.g. 1[sec]) is smaller. Therefore, the reference conduction $\alpha$0 angle is determined at a larger value. Thus, the reference conduction angle $\alpha$0 is predetermined properly.

In the sub-routine of FIG. 7, first, it is determined whether the power supply frequency is 60[Hz] or 50[Hz] (Step S40). When the power supply frequency is 60[Hz], the reference conduction angle $\alpha$0 is set at 10°, 13°, 16° or 19° depending on whether the speed of the motor 27 is a) smaller than 1100[r.p.m.], b) between 1100–1200[r.p.m.], c) between 1200–1300[r.p.m.], or d) larger than 1300[r.p.m], respectively (Steps S41, S42, S43, S44, S45, S46 and S47). When, on the other hand, the power supply frequency is 50[Hz], the reference conduction angle $\alpha$0 is set at 15°, 19°, 23° or 27° depending on whether the speed of the motor 27 is a) smaller than 1100[r.p.m.], b) between 1100–1200[r.p.m.], c) between 1200–1300[r.p.m.], or d) larger than 1300[r.p.m], respectively (Steps S48, S49, S50, S51, S52, S53 and S54).

It should be noted that Step S40 for detecting the power supply frequency is not required if the clothes dryer is designed for use in an area where only one frequency is adopted for the commercial power supply.

Figure 8:
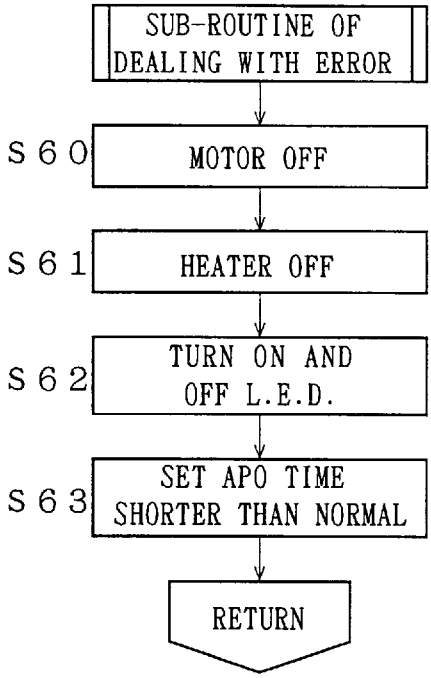
FIG. 8 is a flow chart of a sub-routine of dealing with an error included in the process of detecting the abnormality in the V-belt.

Referring to FIG. 8, the sub-routine of dealing with an error is described as follows. In this sub-routine, the power supply to the motor 27 is turned off by setting the motor-on signal to be continuously low (Step S60), and the power supply to the first and second heaters 25*a* and 25*b* is turned off to stop heating (Step S61). Further, all or some of the LEDs 44 on the operation panel 36 are turned on and off intermittently by the LED driving circuit 62 as an emergency signal to the user (Step S62). Finally, an automatic power-off time (APO time), by which the activation of the automatic power-off circuit 67 is delayed from the end of a drying operation, is set shorter than when the drying operation is completed normally (Step S63). For example, when the APO time for the normal completion is 5[min], the APO time for the abnormal completion may be 1[min]. After that, when the APO time has elapsed since the power supply to the motor 27 and the heater 25 is stopped in response to the detection of the abnormality, the power is turned off automatically.

In the above process, the LEDs are turned on and off to inform the user of the abnormality, and it is also preferable to use the electronic buzzer 45 to generate a sound for alerting the user.

In addition, it should be appreciated that the above embodiment is just illustrative and not restrictive, and the present invention can be modified variously within the true spirit and scope thereof.

What is claimed is:

1. A clothes dryer for performing a drying operation including steps of supplying air heated by a heater into a drum containing clothes to be dried, dehumidifying the air passed through the drum by cooling the air, and supplying the dehumidified air into the drum, thus generating a circulation of the air, said drum being driven via a belt by a motor, comprising:

a) rotation detecting means for generating a rotation signal for each preset rotation of the motor;

b) motor controlling means for driving the motor for a first predetermined period of time and then stopping a power supply to the motor for a second predetermined period of time in an initial phase of the drying operation;

c) rotation counting means for counting the number of rotation signals generated by the rotation detecting means during the second predetermined period of time;

d) abnormality detecting means for detecting an abnormality by comparing the number of the rotation signals counted by the rotation counting means to a predetermined value; and e) operation arresting means for stopping the drying operation when an abnormality is detected by the abnormality detecting means.

2. The clothes dryer according to claim 1, wherein the motor control means also stops the power supply to the motor for a third predetermined period of time after the drying operation is carried out for a predetermined period of time, the rotation counting means counts the number of rotation signals generated by the rotation detecting means during the third predetermined period of time, and the operation arresting means stops the drying operation when an abnormality is detected by the abnormality detecting means.

3. The clothes dryer according to claim 2, comprising load estimating means for estimating a load on the motor before the power supply to the motor is stopped for detecting the abnormality after the drying operation is carried out for the predetermined period of time, and further characterized in that, when the load is found to be smaller than a predetermined value, the power supply to the motor is stopped to detect the abnormality.

4. The clothes dryer according to claim 3, wherein the rotation of the motor is controlled by a phase control method, and the load estimating means estimates the load on the motor based on a phase control angle corresponding to a power supplied to the motor while the motor is controlled to rotate at a predetermined speed.

5. The clothes dryer according to claim 3, wherein an additional process of detecting the abnormality is carried out a plurality of cycles even when no abnormality is detected in the abnormality detecting operation carried out after the drying operation is continued for the predetermined period of time, and if no abnormality is detected in the additional process, the drying operation is continued further, where the additional process includes steps of driving the motor for a fourth predetermined period of time, then stopping the power supply to the motor for the third predetermined period of time, and comparing the number of rotation signals generated by the rotation detecting means during the third predetermined period of time to a predetermined value.

* * * * *